United States Patent [19]

Schmeiss

[11] Patent Number: 4,842,273

[45] Date of Patent: Jun. 27, 1989

[54] VARIABLE COMPRESSION RESISTANCE EXERCISE DEVICE

[76] Inventor: Reinhard Schmeiss, 31 Lindall St., Laguna Niguel, Calif. 92677

[21] Appl. No.: 71,753

[22] Filed: Jul. 9, 1987

[51] Int. Cl.[4] ..... A63B 21/02

[52] U.S. Cl. ..... 272/141; 272/137

[58] Field of Search ..... 272/67, 68, 135–138, 272/140–142, 130

[56] References Cited

U.S. PATENT DOCUMENTS

| | | | |
|---|---|---|---|
| 843,291 | 2/1907 | Mullins | 272/68 |
| 2,132,862 | 10/1938 | Pilates | 272/137 |
| 3,003,764 | 10/1961 | Yovanovitch | 272/141 |
| 4,239,212 | 12/1980 | Hickey | 272/137 |
| 4,556,217 | 12/1985 | Kochan | 272/137 |

FOREIGN PATENT DOCUMENTS

| | | | |
|---|---|---|---|
| 2051786 | 5/1972 | United Kingdom | 272/141 |

*Primary Examiner*—Richard J. Apley
*Assistant Examiner*—J. Welsh
*Attorney, Agent, or Firm*—Stetina and Brunda

[57] ABSTRACT

A pair of axially telescoping members each mount plural springs within their interior. The telescoping members are held together in coaxial alignment by a rod. A spring loaded indexing mechanism about the rod allows racheting between preferential angular orientations of the first member relative to the second member. At these angular orientations various ones of the plural springs within the bore of each telescoping sleeve may be placed in coaxial position. By the number of springs which are selectively coaxially positioned the device accords a varying resistance to compression which is useful for exercizing muscles.

6 Claims, 2 Drawing Sheets

Fig. 2
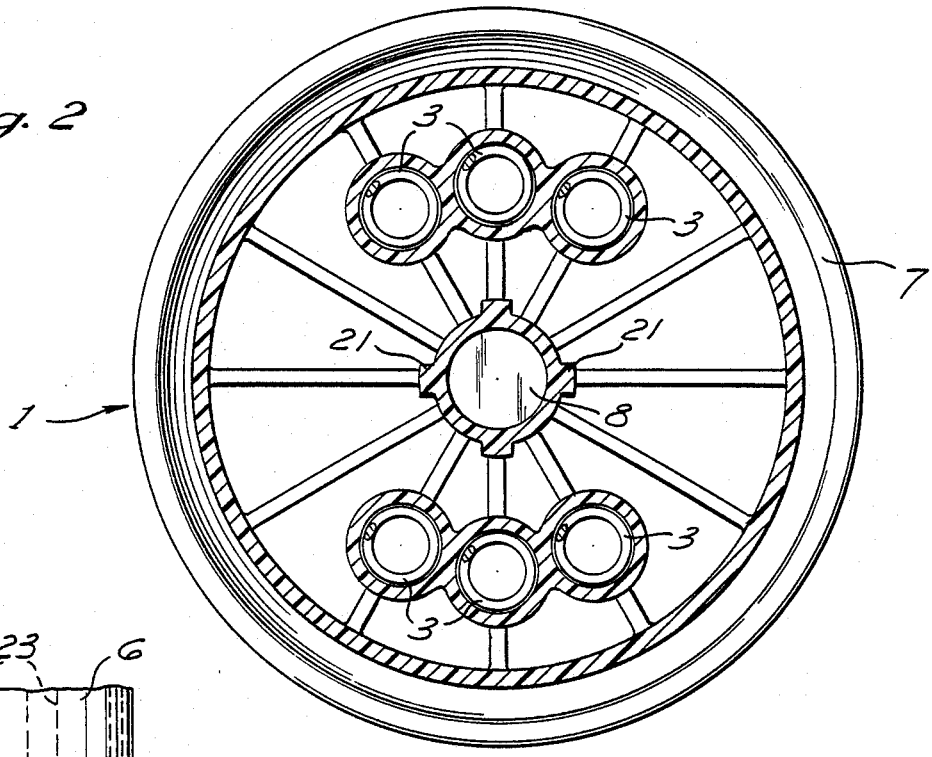
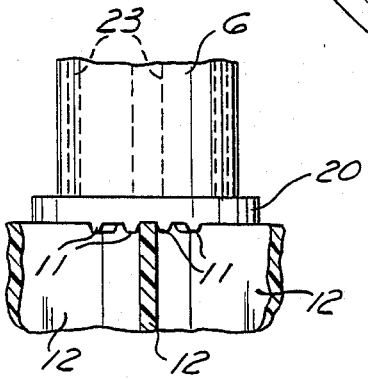
Fig. 4
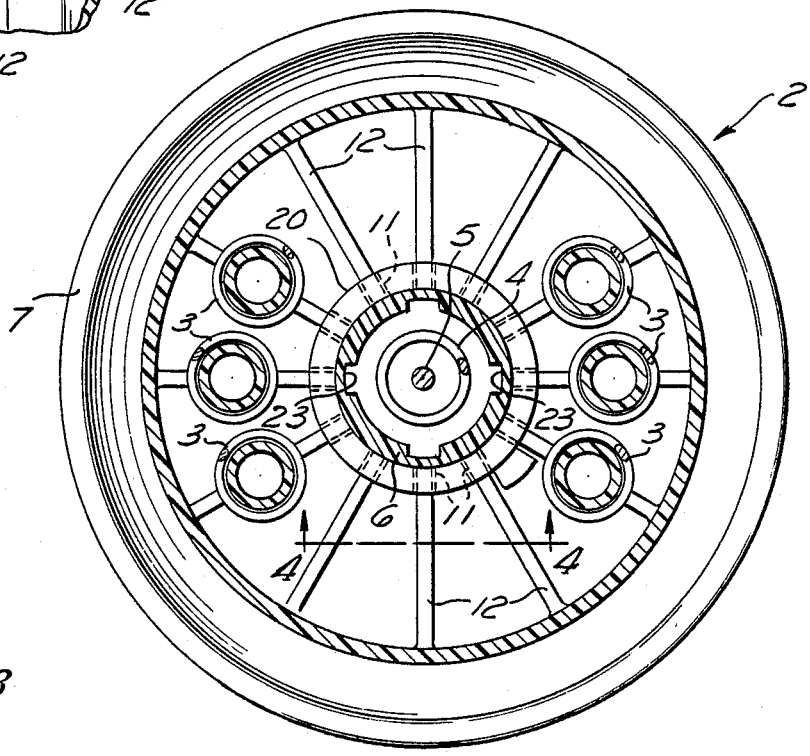
Fig. 3

VARIABLE COMPRESSION RESISTANCE EXERCISE DEVICE

BACKGROUND OF THE INVENTION

It is known in the prior art to use mechanical exercise devices which are resistive to compression for the purposes of body building and the general strengthening and toning of muscles. for certain applications, such as home use or public use outside of gymnasiums or spas, it is especially useful that such exercise devices should be compact and portable.

Because the musculature of the body which is subject to development with exercise devices varies in strength and tone, it is also useful that such a device be of variable resistance in compression. For example, a single exercise device may usefully be compressed between the knees in order to strengthen the inner thigh muscles and may also be compressed between the hands in order to strengthen the chest and arm muscles. It is useful that the resistance of the exercise device to compression might be varied for different exercises being performed by the same person, and might also be varied between uses of the same device by different persons exhibiting different degrees of strength.

Correspondingly, the present invention concerns the realization of selectively variable compression resistance in a compact compression exercise device.

SUMMARY OF THE INVENTION

The present invention is embodied in a compact exercise device which is variably selectively adjustable in the resistance which it presents to compression. The preferred embodiment of an exercise device in accordance with the present invention includes two telescoping members, nominally two capped or closed end cylinders having their open ends opposed one to the other for telescoping relative to the one another along their common cylindrical axis. These two capped cylinders, which may present end caps which are appropriately contoured for engaging body members, constitute the external appearance of the preferred embodiment of the exercise device.

The cylinders are biased in separation by a central spring. This spring acts against a central rod positioned between the cylinders which maintains the cylinders in alignment and prevents their complete separation. Further within each of the two telescoping cylinders are a plurality of springs nominally six in number, which are disposed symmetrically within the interior of the cylinders upon a common radius or diameter from the axis of the cylinders. These springs are individually sized and arculately positioned to be returned within each telescoping cylinder so that none to all of these springs will engage the structure of the opposing cylinder, nominally through none to all of the counterpart springs within this opposing cylinder, to offer spring force resistance to the telescoping compression of the cylinders one towards the other. The variable resistance to compression is realized by the numbers of opposing springs which are engaged one to the other.

In accordance with the present invention, an index mechanism is disposed between the two telescoping cylinders. The index mechanism registers respective ones of the springs attached within the interior of each cylinder to be in end-to-end, i.e. coaxial, opposing engagement through ones of the oppositely juxtaposed springs with the opposite cylinder. The index mechanism may be racheted by twisting the cylinders one relative to one another to a plurality of locations. At these locations variously different numbers of the springs within each cylinder are axially aligned, and are engaged end-to-end for forcing the cylinders in separation. The cylinders are always held in alignment for racheting relative to one another, by a spline and are always held against separating, by the central rod.

BRIEF DESCRIPTION OF THE DRAWINGS

These and other aspects and attributes of the present invention will become increasingly clear upon reference to the following drawings and accompanying specification wherein:

FIG. 2 shows a cut away plan view, taken along aspect line 2—2 shown in FIG. 1, of a first telescoping cylinder within the preferred embodiment of an exercise device in accordance with the present invention.

FIG. 3 shows a cut away plan view, taken along aspect line 3—3 shown in FIG. 1, showing a second telescoping cylinder within the preferred embodiment of an exercise device in accordance with the present invention.

DESCRIPTION OF THE PREFERRED EMBODIMENT

Figure 1:
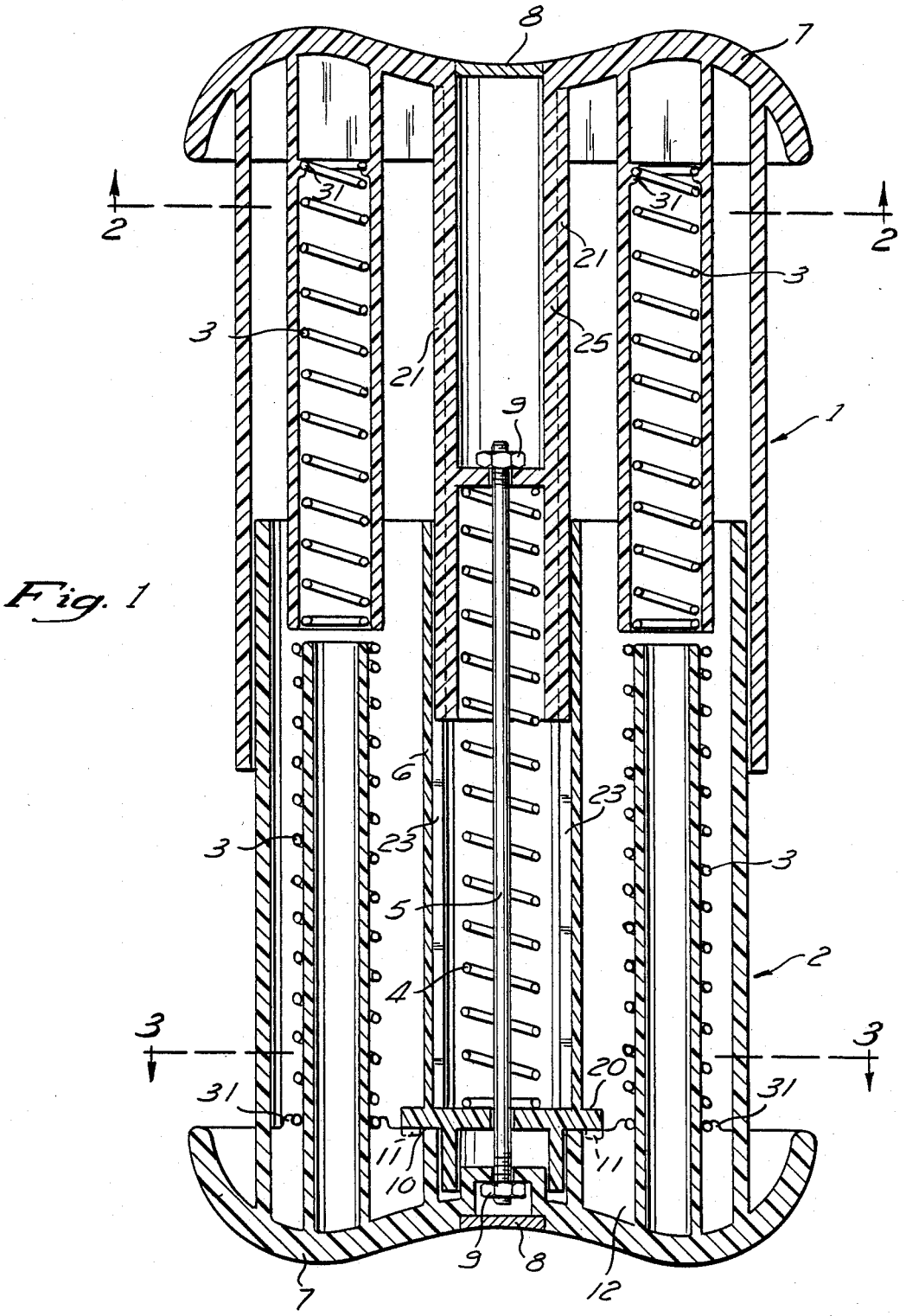
FIG. 1 shows a cut away side plan view showing the preferred embodiment of a variable compression resistance exercise device in accordance with the present invention.

The preferred embodiment of a variable compression resistance exercise device in accordance with the present invention is generally shown in plan view in FIG. 1-4. The device includes two telescoping members, nominally upper cylinder 1 and lower cylinder 2, which are both (i) rotatable relative to one another and (ii) compressible relative to one another along a common central axis. As will be recognized, the designation of upper and lower is utilized herein merely for the purpose of explanation and not for limitation on the orientation of the device. Each of the cylinders 1 and 2 has an end cap 7 which may optionally mount a plug 8 inserted after assembly of the exercies device. The end caps 7 may be suitably contoured, such as with the illustrated saddle shape, for facilitating the device being compressibly held between the knees, hands, or other parts of the human body.

The first, upper telescoping cylinder 1 and the second, lower, telescoping cylinder 2 are held connected to one another, and in coaxial alignment, by the steel rod 5. The steel rod 5 is nominally attached by fasteners, preferably by nuts 9, at a position under plugs 8 to the end caps 7 of each of the telescoping cylinders 1, 2. A sleeve 6 is coaxially positioned within the interior of the lower cylinder 2 and extends axially downward from upper cylinder 1 coaxially about the location of the rod. The inside diameter of sleeve 6 is provided with one or more rectangular grooves 23 which extend axially throughout its length. These grooves 23 engage complementary shaped splines 21 formed on the outside diameter of an elongate tubular member 25 extending axially downward from the end cap 7 of cylinder 1. By such an arrangement, it will be recognized that the cylinders 1 and 2 may be axially telescoped along the length of the splines 21 and grooves 23 yet rotational movement of the sleeve 6 relative the tubular member 25 is prevented by engagement of the splines 21 and grooves 23. This sleeve 6 is spring biased in extension from upper cylinder 1 by spring 4 which is also coaxial about rod 5. The spring 4 is nominally disposed within the sleeve 6, but it could also be located exterior to this sleeve 6. The spring-biased telescoping sleeve 6 presents near its lower circumferential edge of region 10 a plurality of notched flanges 11 (shown in FIG. 4). These notched flanges engage certain ribs, or spiders 12 (shown in FIG. 4) which are formed within the lower telescoping cylinder 2. This spring loaded engagement forms an indexing, racheting, or mechanical detent mechanism by which the telescoping cylinders 1, 2, are biased to be maintained in a one of several preferred positions of angular rotation relative to one another.

Each of the telescoping cylinders 1 and 2 mount a plurality, nominally six, springs 3 circumferentially around its internal bore and coaxially therewith. The springs 3 are each affixed or captured at one end thereof adjacent the respective cylinder 1 and 2 by pressfit, lockring, or other suitable fastener 31 The preferred placement of the six springs 3 within the upper telescoping cylinder 1 is most clearly observable within FIG. 2. The six springs 3 are preferably symmetrically disposed upon a common radius at 30 degrees arcuate separation, and are grouped as three springs 3 disposed on opposite sides of the centerline of the cylinders. The corresponding positions of the six springs 3 within the lower telescoping cylinder 2 is best illustrated in FIG.3. These six springs 3 are also preferably grouped as three springs 3 at 30 degrees arcuate separation symmetrically opposite to another three springs 3.

The upper telescoping member 1 is angularly rotatable relative to the lower telescoping member 2 so that either 0, 2, 4, or all 6 of the springs 3 which are within a one of the telescoping members may be coaxially registered end-to-end relative to their counterpart springs which are within the other one of the telescoping members. Particularly, when the springs 3 are positioned in the relative alignments shown within FIGS. 2 and 3, only the center spring 4 (shown in FIG. 1) is compressed by a movement of the upper telescoping cylinder 1 toward the lower telescoping cylinder 2. The compression of this single center spring 4 results in the least resistance to compression which is offered by the variable compression resistance exercise device in accordance with the present invention.

If the upper telescoping cylinder 1 is rotated 30 degrees in a clockwise direction relative to the lower telescoping cylinder 2 from this position wherein only the center spring 4 is compressed, then two of the springs 3 within the upper telescoping member 1 will be coaxially aligned, and compressing, a corresponding two of the springs 3 which are within the lower telescoping member 2. This coaxial alignment of two pairs of springs end-to-end accords a moderate degree of spring force resistance to compression. If the upper telescoping cylinder 1 is continued to be rotated in the same direction relative to the lower telescoping cylinder 2, for a net total displacement of 60 degrees, then four of the springs 3 within the upper telescoping cylinder 1 will be coaxially aligned relative to, and compressing, a counter-part four springs within the lower telescoping member 2 during the forced compression of such telescoping members one towards the other. In this position a heavier resistance to compression is accorded. Finally, when the upper telescoping cylinder 1 is rotated relative to the lower telescoping cylinder 2 for still another 30 degrees, for a total angular displacement of 90 degrees since rotation was commenced, then all six of the springs 3 within the upper telescoping cylinder 1 will be aligned end-to-end relative to their counter-part springs 3 within the lower telescoping cylinder 2. Upon an attempted compression of the upper telescoping cylinder 1 towards the lower telescoping cylinder 2 these six pairs of springs will combinatorily offer a maximum resistance to such compression.

The upper telescoping cylinder 1 is held at the various angular displacements, nominally in 30 degree increments, relative to lower telscoping cylinder 2 by an indexing mechanism. Particularly, the internal sleeve 6 which telescopes internally within the device from the upper telescoping cylinder 1, and which is held from rotating relative thereto by a spline 21 may be recalled to be spring loaded by spring 4 against the lower telescoping cylinder 2 at the position 10 (all shown in FIG. 1). The lower telescoping cylinder 2 presents twelve ribs, or spiders, 12 at the end surface of its interior bore. The telescoping sleeve 6 presents a nominal twelve notched flanges 11 near its lower circumferential edge. The twelve notched flanges 11 engage a corresponding twelve ribs, or spiders, 12. This engagement is in a manner which is shown in detail for a typical one notched flange 11 and a typical one rib 12 within FIG. 4. The complementary notched flange 11 and rib 12 edge surfaces serve as a simple mechanical detent which will be engaged once during each 30 degrees rotation of the upper telescoping cylinder 1 relative to the lower telescoping cylinder 2. Since the sloping surfaces of notched flange 11 permit the rib 12 to escape the notch on application of sufficient torsion between telescoping cylinders 1, 2, the entire mechanism works as a rachet which serves to selectively index the two telescoping cylinders 1, 2, at a total of twelve angular positions relative to each other. In these 12 positions four different degrees of resistance to compression may be realized.

Besides the obvious compactness, and variable resistance to compression obtained with the preferred embodiment of an exercise device in accordance with the present invention, the device offers additional advantages. It will be obvious to a skilled technician in the art of exercise equipments' design that instead of utilizing the multiple springs for compressive resistance it would be possible to employ a series of solid posts (substituting for one set of springs) circumferentially within the bore of a one telescoping sleeve and to employ springs within the bore of the other telescoping sleeve. However, it is preferable that springs should be registerd end-to-end relative to still other springs, as is the case in the preferred embodiment of the exercise device, in order that a maximum length long stroke of the springs should be obtained while still keeping the overall device compact. By having a long stroke, the springs exhibit approximately equal force per unit compression over their operating range, which is desirable for use of the device in exercising.

Also inherently advantageous within the preferred embodiment of a variable compression resistance exercise device in accordance with the present invention is the considerable range of resistance to compression which can be obtained. The individual springs which are at various times registered and compressed need not be identical, nor of identical resistance to compression. Even if all the springs are substantially identical, a useful range of resistance to compression of the order of thirteen to 1 (13:1) is obtained. This wide range is useful to exercising the different muscles groups of a one individual, or the same muscles between individuals of varying strength.

Corresponding to these and other obvious advantages and adaptations, the present invention should be interpreted in accordance with the following claims, only, and not solely in accordance with that particular preferred embodiment of an exercise device within which the invention has been taught.

What is claimed is:

1. An exercise apparatus comprising:

a pair of coaxial members telescoping relative to each other along their common axis;

a plurality of opposing springs affixed to the pair of coaxial members for biasing the coaxial members toward separation when engaged therebetween; and a rotary index mechanism rotatable about the common axis and disposed between the pair of coaxial members for registering selected ones of the plurality of springs in engagement between the pair of coaxial members.

2. The exercise apparatus according to claim 1 wherein the pair of coaxial members comprise:

a pair of capped cylinders with their open ends opposed on to the other for telescoping about their common axis;

wherein at least some of the plurality of springs are disposed radially about one of said cylinder caps at positions within the cylinder: and wherein the idex mechanism comprises;

a rotary mechanical racheting mechanism for being selectively rotationally positioned to a plurality of locations wherein variously different numbers of the plurality of springs are engaged between the capped cylinders for force biasing the separation thereof.

3. The exercise apparatus according to claim 2 wherein the rotary mechanical racheting mechanism comprises:

a plurality of radial spider partitions within one of the pair of capped cylinders;

a flange within the other one of the pair of capped cylinders which flange presents a complementary surface to engage the edge of each one of the plurality of spider partitions in order to prevent rotation of the capped cylinders relative to each other; and a spring for biasing the flange into contact with the plurality of partitions so that the pair of capped cylinders are indexed relative to one another.

4. An exercise apparatus comprising:

a pair of telescoping members;

a plurality of biasing means, disposed between the pair of telescoping members, each for force biasing the pair of telescoping members towards separation when engaged therebetween;

wherein a first, group of the plurality of biasing means are affixed to a first one of the pair of telescoping members; and wherein a second, group of the plurality of biasing means are affixed to a second one of the pair of telescoping members;

an index mechanism disposed between the pair of telescoping members for registering selected ones of the first plurality of biasing means in engagement with the second plurality of biasing means;

wherein the first group of the plurality of biasing means are, when registered by the index mechanism, selectively axially aligned with selected ones of the second group of the plurality of biasing means.

5. A method of making a selectively variable compression resistant exercise equipment comprising;

forming two capped cylinders of complementary size for telescoping one relative to other at their opposed open ends and along their common axis;

affixing within the bores of each cylinder a plurality of springs at radial positions around the bore;

mechanically maintaining the cylinders in axial alignment while permitting their rotation one relative to the other about their common axis;

wherein the maintaining of alignment while permitting rotation allows that selective ones of the plurality of springs in one of said cylinders may be brought into abutting juxtapositions with selective springs in the other of said cylinders upon a corresponding selective rotation of the cylinders and will, in these juxtapositions, provide a resistance to telescoping compression of the cylinders which resistance is selectively variable with the selective rotation.

6. The method according to claim 5 further comprising:

mechanically indexing the two cylinders for rotation relative to one another.

* * * * *